US005778602A

United States Patent [19]

Johnson et al.

[11] Patent Number: 5,778,602

[45] Date of Patent: Jul. 14, 1998

[54] PICK RESISTANT WINDOW LOCK MANUAL CONTROL

[75] Inventors: Douglas G. Johnson, Blooming Prairie; Timothy T. Frenzen, Owatonna; Joseph P. Landherr, Rose Creek, all of Minn.

[73] Assignee: Truth Hardware Corporation, Owatonna, Minn.

[21] Appl. No.: 781,939

[22] Filed: Dec. 3, 1996

[51] Int. Cl.[6] ..... E05B 55/00

[52] U.S. Cl. ..... 49/449; 292/DIG. 47

[58] Field of Search ..... 70/89, 90, 95, 70/99, 100; 292/DIG. 46, DIG. 47, DIG. 33, DIG. 35; 49/394, 449

[56] References Cited

U.S. PATENT DOCUMENTS

| | | | |
|---|---|---|---|
| D. 316,509 | 4/1991 | Nolte . | |
| D. 334,132 | 3/1993 | Wobschall et al. . | |
| 1,596,935 | 8/1926 | Marshall | 292/DIG. 47 X |
| 3,468,142 | 9/1969 | Sprung | 70/89 |
| 4,095,829 | 6/1978 | Van Klompenburg . | |
| 4,428,154 | 1/1984 | Rinehart | 49/394 X |
| 4,621,847 | 11/1986 | Paulson et al. . | |
| 4,736,972 | 4/1988 | Mosch | 292/DIG. 47 X |
| 4,991,886 | 2/1991 | Nolte et al. . | |
| 5,087,087 | 2/1992 | Vetter et al. . | |
| 5,118,145 | 6/1992 | Tucker . | |
| 5,152,103 | 10/1992 | Tucker et al. . | |
| 5,172,520 | 12/1992 | Hostetler et al. | 49/449 |
| 5,301,989 | 4/1994 | Dallmann et al. . | |
| 5,489,131 | 2/1996 | Blom . | |

OTHER PUBLICATIONS

Truth Brochure Multi Gard™ Sash Lock, pp. 10.2–10.2b (1993).

Truth Brochure "Sash Lock", pp. 2.1–2.1a (1996).

Truth Brochure "Non-Handed, Low Profile Sash Lock", pp. 2.2–2.2c (1996).

Truth Brochure "Home Gard™ Sash Lock", pp. 2.3–2.3c (1996).

Truth Brochure "Locking Handle", pp. 2.7–2.7g (1996).

Truth Brochure "Multi-Point Locking System", pp. 2.8–2.8g (1996).

(List continued on next page.)

*Primary Examiner*—Jerry Redman
*Attorney, Agent, or Firm*—Wood, Phillips, VanSanten, Clark & Mortimer

[57] ABSTRACT

A lockable window, and a manual control for a lockable window. The window includes a window sash having a first locking member and a window frame having a second locking member mounted thereon for movement between a locked position cooperating with the first locking member for locking the sash to the frame when closed against the frame and an unlocked position clear of the first locking member to allow movement of the sash relative to the frame. The frame also has an opening therein for allowing access to the second locking member from an interior side of the frame. The lock control has a housing including an enclosure open on one side with a flange around the open one side, the housing being mounted with its enclosure substantially in the frame opening and its flange on the interior side of the frame. A handle is pivotally secured in the housing enclosure and includes an opening at one end. A hard, resilient plastic retainer substantially surrounds the frame opening and is disposed between the frame interior side and the housing flange to substantially seal against leakage through the frame opening to the frame interior side. The retainer further includes a flexible hook portion received in the handle opening when the handle is in the locked position, where pivoting the handle out of the locking position requires a pivoting force sufficient to flex the hook portion clear of the handle. The hook portion is adaptable for use with both right and left hand operation. The handle is operably connected to the second locking member so that pivoting of the handle between locking and unlocking positions selectively moves the second locking member between the locked and unlocked positions.

24 Claims, 2 Drawing Sheets

OTHER PUBLICATIONS

Truth Brochure "Entrygard® Sash Lock", pp. 11–11a (1991).
Truth Brochure "Non–Handed, Low Profile Sash Lock", pp. 12–12c (1991).
Truth Brochure "Sash Lock", pp. 13–13a (1991).
Truth Brochure "Concealed Casement Hardware–Lock", pp. 13.1–13.1b (1991).
Truth Brochure "Locking Handle", pp. 14–14e (1988).
Truth Brochure "Multi–Point Locking System", pp. 20.1–20.1e (1989).

PICK RESISTANT WINDOW LOCK MANUAL CONTROL

BACKGROUND OF THE INVENTION

1. Technical Field

The present invention is directed toward a window lock, and more particularly toward a handle structure for controlling a multipoint lock for a casement window.

2. Background Art

Window locks are obviously well known, and provide a wide variety of locking configurations and operations. A variety of cam and keeper locks have long been used, for example, with casement windows, where the cam and the keeper are brought into interference with one another for locking, and moved apart to allow opening of the window. One such type of window locking structure, known as a multipoint lock, uses multiple cams and keepers spaced along one side of the window operator. Such locks are shown, for example, in U.S. Pat. Nos. 4,991,886, 5,118,145 and 5,152,103, the contents of which are hereby incorporated by reference.

Such locks are most often manually controlled by a pivoting handle operably connected to a tie bar movable along one side of the window frame, where pivoting of the handle moves the connected tie bar and the cam members thereon into or out of engagement with associated keepers on the window sash, as shown, for example, in U.S. Pat. Nos. 4,991,886 and 5,118,145. Still other control structures can, however, also be used with the window locks, including unified connections to the operator which opens and closes the sash (as shown, for example, in U.S. Pat. No. 5,152,103), as well as motorized controls (often in combination with a manual controls in case of power outage or the like).

With such controls, particularly manual controls having handles which must be connected to the locking elements on one side of the frame while also allowing access to the handle on the other side of the frame, there is often a problem with leakage through the frame around the required opening. Such leakage can obviously be a problem in severe weather when rain water, for example, might leak through into the inside of the window. Such leaks can be sources of significant energy losses around the window (whether heat enters from the outside when the dwelling is being air conditioned during hot weather or leaks out when being heated during cold weather). Further, light can leak through the opening and significantly inhibit the aesthetic appearance of the window, not only drawing attention from the desired visual opening of the window as designed but also giving the appearance of a low quality structure.

Further, pivoting handle locks are susceptible to being picked by a potential intruder able to gain access to the locking structure from outside the window and dwelling. For example, with multipoint locks, an intruder may be able to gain access to the tie bar from outside the structure and then manipulate the tie bar to move the cams free of the keepers and thereby allow the window sash to be freely opened. U.S. Pat. No. 4,991,886 discloses a structure which addresses this problem through the connection of the handle to the tie bar. Such a pick resistance feature cannot be used, however, in installations where such a loose handle/tie bar connection is not desired or suitable.

The present invention is directed toward overcoming one or more of the problems set forth above.

SUMMARY OF THE INVENTION

In one aspect of the present invention, a manual control for a window lock structure having first and second locking members is provided, where the first locking member is associated with a window frame and the second locking member associated with a window sash. The manual control includes a handle securable for pivoting relative to the window frame and operably connectable to the first locking member whereby pivoting of the handle when connected to the first locking member operably moves the first locking member into and out of locking orientation relative to the second locking member. A resilient retainer securable to the window frame includes means for releasably securing the handle in a locking position in which a connected first locking member is in locking orientation relative to a second locking member.

In a preferred form, the retainer is made of a hard resilient plastic.

In another preferred form of the present invention, the retainer securing means is a finger having a hook at one end engaging the handle in the locking position, whereby pivoting the handle out of the locking position requires a pivoting force sufficient to flex the finger to disengage the hook from the handle.

In still another preferred form of the present invention, the handle is pivotally secured relative to one end and is manually engageable on its other end, with the handle other end further including an opening therein receiving the finger in the locking position. Further, the handle in the locking position includes a side facing away from the window frame, and the finger hook engages the handle side when in the locking position.

In another aspect of the present invention, a manual control for a structure for locking a window sash to a window frame is provided, including a housing receivable in a frame opening having an outer boundary and a flange about the housing having an outer boundary greater than the outer boundary of a frame opening. A handle is pivotally secured to the housing and operably securable to a window locking structure for controlling a window locking structure in response to pivoting of the handle. A plastic gasket is disposed about the housing and adjacent the flange and includes an integrally formed flexible hook adapted to releasably secure the handle in one position relative to the housing.

Preferred forms of this aspect of the present invention include the previously discussed preferred forms of the first aspect of the invention. Another preferred form of this aspect of the present invention is the provision of a gasket which may be oriented to place the hook at either end of the housing.

Still another aspect of the present invention is a lockable window including a window sash having a first locking member and a window frame having a second locking member mounted thereon for movement between a locked position cooperating with the first locking member for locking the sash to the frame when closed against the frame and an unlocked position clear of the first locking member to allow movement of the sash relative to the frame. The frame also has an opening therein for allowing access to the second locking member from an interior side of the frame. A housing includes an enclosure open on one side with a flange around the open one side and is mounted with its enclosure substantially in the frame opening and its flange on the interior side of the frame. A handle is pivotally secured in the housing enclosure, and a retainer substantially surrounding the frame opening is disposed between the frame interior side and the housing flange to substantially seal against leakage through the frame opening to the frame interior side. The retainer further includes a flexible hook portion adapted to releasably secure the handle in the locked position. The handle is operably connected to the second locking member so that pivoting of the handle between locking and unlocking positions selectively moves the second locking member between the locked and unlocked positions.

Preferred forms of this aspect of the present invention include the previously discussed preferred forms of the other aspects of the invention.

In another preferred form, this aspect of the present invention includes two substantially parallel housing enclosure side walls extending at substantially right angles from the housing flange and a connecting wall between the side walls, with the side walls and connecting walls defining a generally longitudinal slot for pivoting of the handle. In a preferred variation of this form of the present invention, the connecting wall is substantially V-shaped.

In still another preferred form, this aspect of the present invention includes aligned openings through the enclosure side walls, with a link operably connected on one end to the second locking member and having a laterally extending shaft on its other end. The link shaft is pivotally secured in the side wall openings and connected to the handle for pivoting therewith. In a preferred variation of this form of the present invention, the link shaft has a non-cylindrical outer surface received in an opening in the handle, the handle opening having a non-cylindrical surface cooperating with the link non-cylindrical surface to secure the link shaft and handle for pivoting together.

It is an object of the invention to provide a window lock and manual window lock control which is easy to operate.

It is another object of the invention to provide a window lock and window lock control which may be easily and inexpensively manufactured and installed, both in new and existing window structures.

It is still another object of the invention to provide a window lock and window lock control which minimizes inventory requirements and prevents inadvertent errors through use of the wrong components in different installations, including installations having both right and left hand operation.

It is yet another object of the invention to provide a window, window lock and window lock control which are energy efficient.

Still another object of the invention is to provide a window, window lock and window lock control which is aesthetically pleasing in appearance and does not detract from the designed beauty of the window.

Yet another object of the invention is to provide a window lock and window lock control which provide security against intruders.

DESCRIPTION OF THE PREFERRED EMBODIMENT

Figure 1:
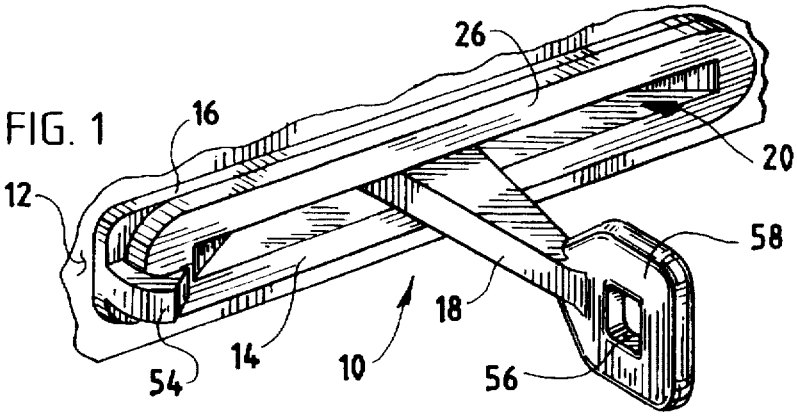
FIG. 1 is a perspective view of the window lock manual control of the present invention as installed in a window frame, with its handle shown in an intermediate position.
Figure 2:
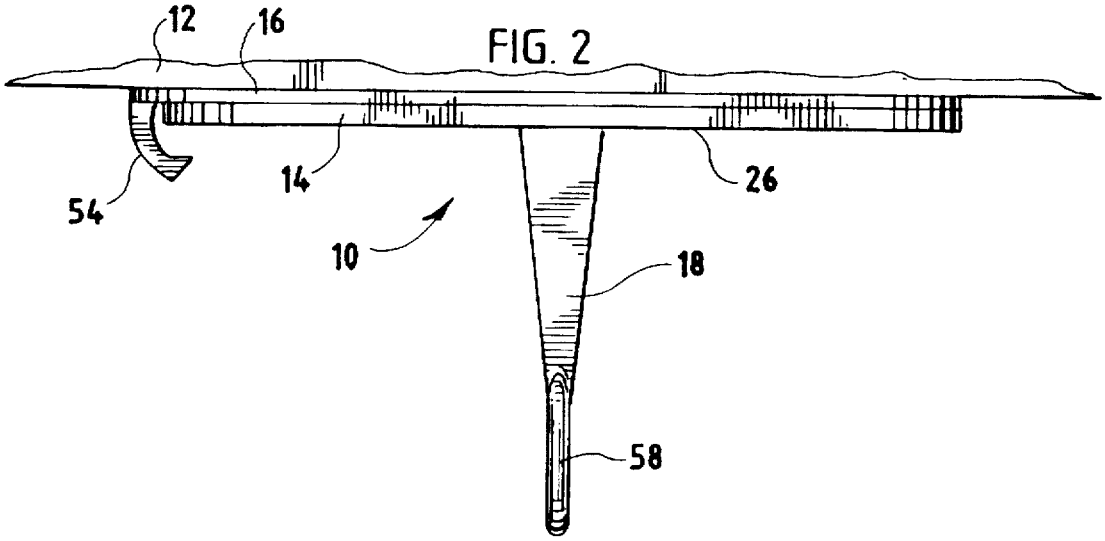
FIG. 2 is side view of the window lock manual control of FIG. 1.

The pick resistant window lock manual control 10 of the present invention is shown installed in a window frame 12 in FIGS. 1–5. The manual control includes an escutcheon 14 secured in a suitable opening in the frame 12. A plastic gasket and retainer 16 is secured between the escutcheon 14 and the window frame 12. A handle 18 is pivotally secured in a slot 20 in the escutcheon 14.

Figure 6:
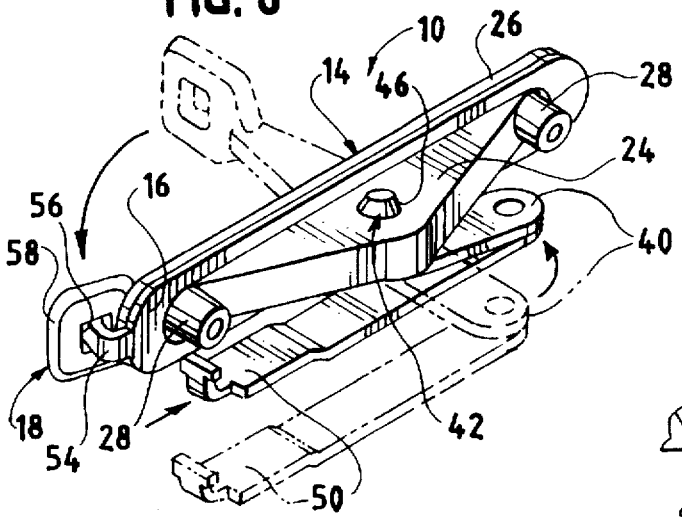
FIG. 6 is a perspective view of the window lock manual control of the present invention.
Figure 7:
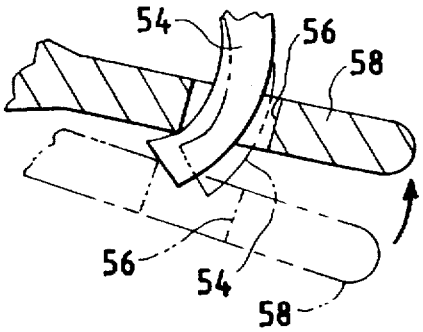
FIG. 7 is a partial cross-sectional side view illustrating the cooperation of the handle and securing member to resist picking of the lock manual control.
Figure 8:
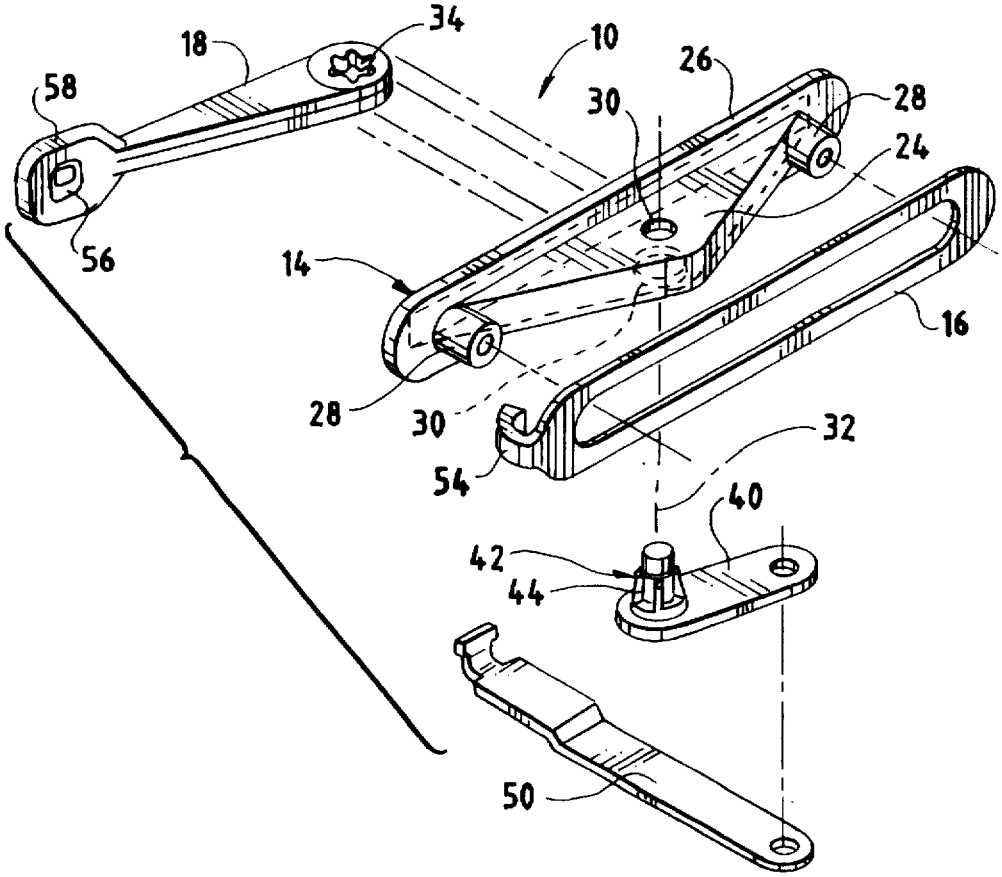
FIG. 8 is an exploded view of the window lock manual control of the present invention.

Referring now to FIGS. 6–8 and showing the above in greater detail, the escutcheon 14 includes a triangular housing portion 24 extending from one side of a surrounding lip or flange 26. The escutcheon 14 further includes a pair of bosses 28 at opposite ends, which bosses 28 receive screws or other suitable fasteners for securing the escutcheon to the frame 12.

The gasket and retainer 16 is preferably made of a flexible plastic and surrounds the housing portion 24 and bosses 28. The flexibility of the gasket and retainer 16 allows it to conform to minor irregularities in the window frame 12 to provide a good seal around the frame opening in which the manual control 10 is secured. This helps to ensure that the window is energy efficient by blocking heat transfer or drafts which might otherwise occur through gaps around the housing opening, and further helps to ensure that the lock is aesthetically pleasing by ensuring that light does not filter through the opening and detract from the appearance. Of course, light leaking through the opening can also give the strong impression of a poorly made structure.

The housing portion 24 includes also includes openings 30 (one is shown in phantom in FIG. 8) concentric with the axis 32 of pivoting for the handle 18. Specifically, the handle 18 at its proximate end includes a non-cylindrical opening 34 aligned with the pivot axis 32. A lock operating arm 40 includes an axial shaft 42 with a non-cylindrical portion 44, so that the shaft 42 may be extended through housing portion openings 30 with the non-cylindrical portion 44 cooperably received in the handle non-cylindrical opening 34 to secure the handle 18 and operating arm 40 for pivoting together about the pivot axis 32. The operating arm 40 is suitably secured to the housing portion 24, as by use of an orbital riveter to form a rivet head 46 on the end of the arm shaft 42 projecting through the housing portion opening 30.

The operating arm 40 is pivotally secured (as by a rivet, not shown) on its other end to a suitable link 50, where the link 50 is also secured in a suitable manner to a window locking structure. For example, the link 50 may be suitably secured to the tie bar of the locking structure shown in U.S. Pat. No. 4,991,886, the contents of which are hereby incorporated by reference, where pivoting of the handle 18 (such as shown in phantom in FIG. 6) will cause the link 50 to move an attached tie bar and thereby operate the window lock structure as is well known in the art.

Figure 3:
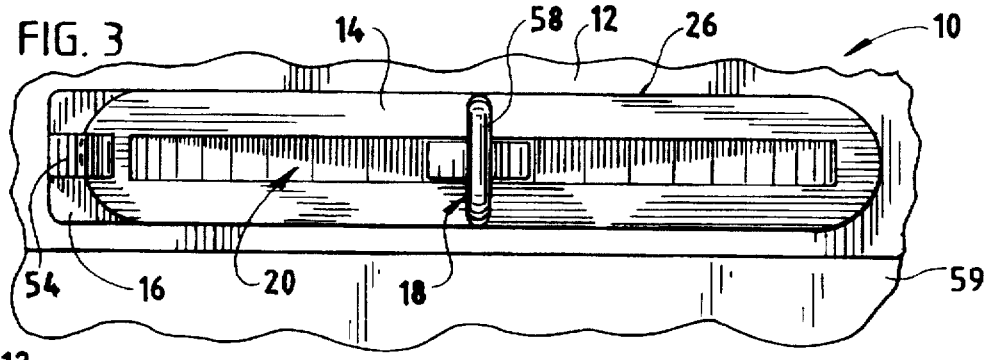
FIG. 3 is a front view of the window lock manual control of FIG. 1 with a broken portion of a window sash also shown.
Figure 4:
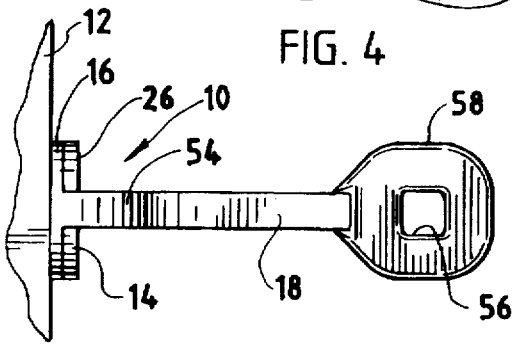
FIGS. 4 and 5 are left and right views of the window lock manual control of FIG. 3.
Figure 5:
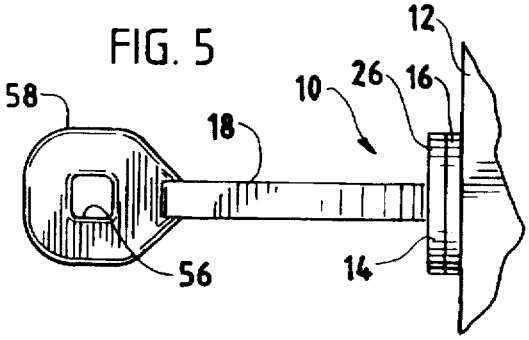

In a preferred form of this invention and as shown in the Figures, the gasket and retainer 16 also include an integral hook portion 54 which cooperates with an opening 56 in the manually graspable portion 58 at the distal end of the handle 18 to releasably secure the handle 18 in its locking position (that is, in the position in which the handle 18 has positioned the locking structure to lock a window sash 59 [see FIG. 3]

against the window frame 12). That is, as illustrated in FIG. 7, the hook portion 54 of the gasket and retainer 16 is flexible so that it will flex back to allow the handle 18 to be moved into or out of the locking position. When the handle 18 is in the locking position as illustrated in FIGS. 6–7, the hook portion 54 is received in the handle opening 56 so that movement of the handle 18 requires an extra force sufficient to flex the hook portion 54 to a position allowing the handle 18 to move past the hook portion 54 (as illustrated in phantom in FIG. 7).

It should be understood, also, that the hook portion 54 could alternatively be positioned to cooperate with the outer edge of the graspable portion 58, in which case the opening 56 would either not be necessary or might be provided to cooperate with a second hook portion to more greatly secure the handle in its locking position.

When a person directly grasps the handle 18 to move it from its locking position, it is relatively easy to move the handle 18, since the force may be applied in the direction required for movement (that is, in the direction of the arc of the path of the handle graspable portion 58) and the person may also directly engage the hook portion 56 with a finger or thumb to flex it toward its releasing position.

Despite the ease of authorized manual operation, a significant resistance to unauthorized opening of the locking structure is still provided. Specifically, sometimes a potential intruder gains access from the outside so as to be able to manipulate the locking structure. Typically, for example, the intruder could gain access to the tie bar so that the intruder is able to apply an axial force to the tie bar to bias it toward moving to its unlocked position. However, as best seen in FIG. 6, such an axial force would apply a force to the operating arm 40 through a very small moment arm relative to the pivot axis 32, so that even a great axial force on a tie bar would apply only a small pivoting moment to the operating arm 40 and attached handle 18. In that case, the resistance to pivoting from the cooperating of the hook portion 54 and the handle opening 56 would be more than sufficient to prevent the locking structure from being moved from its locking position.

It should also be recognized that the gasket and retainer 16 may be readily positioned in either direction relative to the escutcheon 14, so that the hook portion 54 is at either end. Therefore, this structure may be readily used with either right or left handed windows without requiring separate components for each. Accordingly, there is no risk of providing the improper components for particular installations, and inventory costs may be minimized.

The flexible hook portion 54 will also function to assist in moving the handle 18 to its proper locking position, since when the handle 18 is moved past the hook portion 54 toward its locking position, the spring back of the hook portion will tend to bias the handle 18 toward the last bit of pivoting into its locking position. Further, the spring back of the hook portion 54 will provide a positive feel or snap during the operation of the handle 18. Therefore, when the handle 18 is intended to be moved to a locking position but is not pivoted sufficiently to do so, there will be no positive feel or snap indicating proper positioning and the person will therefore more easily recognize that they have not sufficiently pivoted the handle 18. Further, by providing the hook portion 54 only at on end of the gasket and retainer 16, the same lack of a positive feel will indicate to a user that they have made an error should they improperly pivot the handle 18 to its other extreme, with the locking structure completely unlocked. As such, this manual control 10 prevents the handle 18 from being inadvertently left in an inadequately locking position.

It should thus be apparent that this window lock manual control 10 may be easily and inexpensively manufactured and installed, both in new and existing window structures. Inventory requirements are minimal, and inadvertent errors through use of the wrong components in different installations are avoided. This manual control 10 also provides safe, reliable and easy operation, with security against intruders including resistance to picking by an intruder. Further, the manual control is energy efficient and aesthetically pleasing in appearance without detracting from the designed beauty of the window itself.

Still other aspects, objects, and advantages of the present invention can be obtained from a study of the specification, the drawings, and the appended claims.

We claim:

1. A manual control used with a window lock structure having first and second locking members, the first locking member being associated with a window frame and the second locking member associated with a window sash, said manual control comprising:

a handle securable for pivoting relative to the window frame;

means for operably connecting said handle to the first locking member whereby pivoting of said handle when connected to said first locking member operably moves the first locking member into and out of locking orientation relative to the second locking member;

a resilient retainer securable to the window frame, said retainer including means for releasably securing said handle in a locking position and being sufficiently resilient to bend in response to both a manual force applied to the handle to release the handle from the locking position and a manual force applied to the handle to move the handle to the locking position, said handle in said locking position when connected to the first locking member causing said first locking member to be in locking orientation relative to the second locking member.

2. The control of claim 1, wherein said retainer is made of a hard resilient plastic.

3. A manual control used with a window lock structure having first and second locking members, the first locking member being associated with a window frame and the second locking member associated with a window sash, said manual control comprising:

a handle securable for pivoting relative to the window frame;

means for operably connecting said handle to the first locking member whereby pivoting of said handle when connected to said first locking member operably moves the first locking member into and out of locking orientation relative to the second locking member;

a resilient retainer securable to the window frame, said retainer including means for releasably securing said handle in a locking position and including a finger having a hook at one end engaging said handle in the locking position, whereby pivoting said handle out of said locking position requires a pivoting force sufficient to flex said finger to disengage said hook from said handle, said handle in said locking position when connected to the first locking member causing said first locking member to be in locking orientation relative to the second locking member.

4. The control of claim 3, wherein said retainer is made of a hard resilient plastic.

5. The control of claim 3, wherein said handle in the locking position includes a side facing away from the window frame when secured to the window frame, and said hook of said finger engages said side of said handle when in the locking position.

6. The control of claim 3, wherein said handle is pivotally secured relative to one end and is manually engageable on its other end, said other end of said handle further including an opening therein receiving said finger in the locking position.

7. The control of claim 6, wherein said handle in the locking position includes a side facing away from the window frame when secured to the window frame, and said finger hook engages said side of said handle when in the locking position.

8. A manual control used with a structure for locking a window sash to a window frame, comprising:

a housing receivable in a frame opening having an outer boundary;

a flange about said housing having an outer boundary greater than the outer boundary of the frame opening within which said housing is receivable;

a handle pivotally secured to said housing and operably securable to the window locking structure for controlling the window locking structure in response to pivoting of said handle;

a plastic gasket about said housing and adjacent said flange, said gasket further including an integrally formed flexible hook adapted to releasably secure said handle in one position relative to said housing.

9. The control of claim 8, wherein said gasket is made of a hard resilient plastic.

10. The control of claim 8, wherein said handle when secured to the window frame and in said one position includes a side facing away from the window frame, and said gasket hook engages said side of said handle when said handle is in said one position.

11. The control of claim 8, wherein said handle is pivotally secured relative to one end and is manually engageable on its other end, said other end of said handle further including an opening with said hook extending therethrough when said handle is in said one position.

12. The control of claim 11, wherein said handle in said one position includes a side facing away from the window frame when secured to the window frame, and said gasket hook engages said side of said handle when in said one position.

13. The control of claim 8, wherein said housing has a generally longitudinal orientation and said handle is secured for pivoting in a plane in substantially said longitudinal direction, and said gasket is longitudinally oriented with said hook at one end of said longitudinal orientation.

14. The control of claim 13, wherein said gasket may be oriented about said housing with said hook at either end of said housing longitudinal orientation.

15. A lockable window comprising:

a window sash having a first locking member thereon;

a window frame having a second locking member mounted thereon for movement between a locked position cooperating with the first locking member for locking said sash to said frame when closed against said frame and an unlocked position clear of said first locking member to allow movement of the sash relative to the frame, said frame having an opening therein for allowing access to said second locking member from an interior side of said frame;

a housing including an enclosure open on one side with a flange around the one side, said housing being mounted with its enclosure substantially in said opening and its flange on the interior side of the frame;

a handle pivotally secured in the enclosure;

a retainer substantially surrounding said opening and disposed between said interior side and said housing flange to substantially seal against leakage through the opening to the interior side, said retainer further including a flexible hook portion adapted to releasably secure said handle in said locked position; and means for operably connecting said handle to said second locking member whereby pivoting of said handle between locking and unlocking positions selectively moves said second locking member between said locked and unlocked positions.

16. The window of claim 15, wherein said handle in the locking position includes a side facing away from the frame, and said retainer hook portion engages said side of said handle when in the locking position.

17. The window of claim 15, wherein said handle is pivotally secured relative to one end and is manually engageable on its other end, said other end of said handle further including an opening therein receiving said hook portion in the locking position.

18. The window of claim 17, wherein said handle in the locking position includes a side facing away from the frame, and said hook portion engages said side of said handle when in the locking position.

19. The window of claim 15, wherein said enclosure includes two substantially parallel side walls extending at substantially right angles from said housing flange and a connecting wall between said side walls, said side walls and connecting walls defining a generally longitudinal slot for pivoting of said handle.

20. The window of 19 wherein said connecting wall is substantially V-shaped.

21. The window of 19, wherein:

said side walls have aligned openings therethrough; and said means for operably connecting comprises a link operably connected on one end to said second locking member and having a laterally extending shaft on its other end, said shaft being pivotally secured in said aligned openings through said side walls, and means for connecting said handle to said shaft for pivoting therewith.

22. The window of claim 21, wherein said means for connecting said handle to said shaft comprises a non-cylindrical surface about said shaft received in an opening in said handle, said opening in said handle having a non-cylindrical surface cooperating with said link non-cylindrical surface.

23. The window of claim 19, wherein:

said enclosure side walls extend longitudinally between opposite ends along said flange;

said handle is secured for pivoting in a plane substantially parallel to said side walls; and said retainer hook portion is disposed adjacent one end of said side walls.

24. The window of claim 23, wherein said retainer may be oriented with said hook portion at either end of said enclosure side walls.

* * * * *